United States Patent [19]

Harris et al.

[11] 4,437,830

[45] Mar. 20, 1984

[54] BURNER AND PILOT VALVE SAFETY CONTROL SYSTEM

[75] Inventors: Lewis K. Harris; Billie S. Burrus, both of Tulsa, Okla.

[73] Assignee: Combustion Engineering, Inc., Windsor, Conn.

[21] Appl. No.: 399,558

[22] Filed: Jul. 19, 1982

[51] Int. Cl.[3] ..... F23Q 9/08

[52] U.S. Cl. ..... 431/54; 431/53; 431/81; 431/85; 431/90; 236/99 H; 251/11; 137/65; 137/628; 137/613

[58] Field of Search ..... 431/53, 54, 81, 85, 431/90; 236/18, 99 H; 137/628, 613, 65; 251/11

[56] References Cited

U.S. PATENT DOCUMENTS

| | | | |
|---|---|---|---|
| 1,823,122 | 9/1931 | Partlow | 431/85 X |
| 1,943,075 | 1/1934 | Horton | 431/81 X |
| 2,715,437 | 8/1955 | Drow | 431/54 |
| 4,104,016 | 8/1978 | Baysinger | 431/54 |

*Primary Examiner*—Samuel Scott
*Assistant Examiner*—Randall L. Green
*Attorney, Agent, or Firm*—Arthur L. Wade

[57] ABSTRACT

The movable elements of two normally closed valves are actuated by a thermal element responsive to ignition at a pilot burner supplied fuel through one of the valves. The two valve elements form a mechanical train from the thermal element which simultaneously unseats the second valve controlling fuel to the main burner and releases a manually operable mechanism with which the pilot burner valve is initially unseated for ignition.

5 Claims, 3 Drawing Figures

BURNER AND PILOT VALVE SAFETY CONTROL SYSTEM

TECHNICAL FIELD

The present invention relates to the safety control of a main burner and its pilot burner by interlocking the fuel supplies to both burners. More particularly, the invention relates to supplying the pilot and main burners in series from a common fuel supply through a valve system manually initiated and automatically maintained in its "run" position.

BACKGROUND ART

The fired equipment of the oil field is preferrably unattended except for its initial startup and periodic inspection. Therefore, automatic safety systems for both the pilot and main burners are required to avoid the main burner discharging raw fuel which will accumulate in explosive quantities within the fired equipment.

It has been the custom to mount a closed fluid pressure system so it is responsive to the pilot burner and will utilize the mechanical movement produced to maintain the connection of both burners to the fuel supply. Failure of heat at both the main burner and pilot burner reverses the mechanical movement of the system to disconnect the burners from their fuel supply. A cam, or ratchet, has been employed with which to manually connect the pilot burner to the fuel supply until the heat of the burner generates the mechanical movement with which to sustain the connection of the fuel supply to the pilot burner and simultaneously remove the temporary support to the connection afforded by the manually set cam, or ratchet. However, the present systems are arranged so that if the manually operated ratchet system is actuated and the pilot burner fails to remain ignited long enough to bring the closed fluid pressure system into operation long enough to release the ratchet, the main burner remains connected to the fuel supply and permits discharge of the raw fuel from the main burner to accumulate in explosive amounts within the fired equipment. Therefore, it is desirable to positively isolate the main burner from the fuel supply until the pilot burner has been "proved" which will include release of the ratchet mechanism by which the pilot burner was originally connected to the fuel supply.

DISCLOSURE OF THE INVENTION

The present invention contemplates first and second valves which are normally closed, or spring closed. A main burner is supplied fuel through the first valve and the pilot burner is supplied through the second valve. A fuel supply is manually connected to the pilot burner through the second valve. A thermally responsive element is connected to the pilot burner and arranged to engage the elements of both valves and the manually operated mechanism of the second valve to simultaneously open the first valve and remove manual control from the second valve.

The invention further contemplates the first and second valves mounted in a single housing with their valve elements forming a mechanical train between the thermally responsive element and the manually positionable mechanism for the second valve element. So long as heat exists at the pilot burner, the thermally responsive element will maintain both valves open against the force of their springs. When combustion disappears at the pilot burner, the thermally responsive element withdraws and the springs of both valves shut their valves to isolate the fuel supply from both burners.

Other objects, advantages and features of this invention will become apparent to one skilled in the art upon consideration of the written specification, appended claims, and attached drawings.

BRIEF DESIGNATION OF THE DRAWINGS

BEST MODE FOR CARRYING OUT THE INVENTION

General

Figure 1:
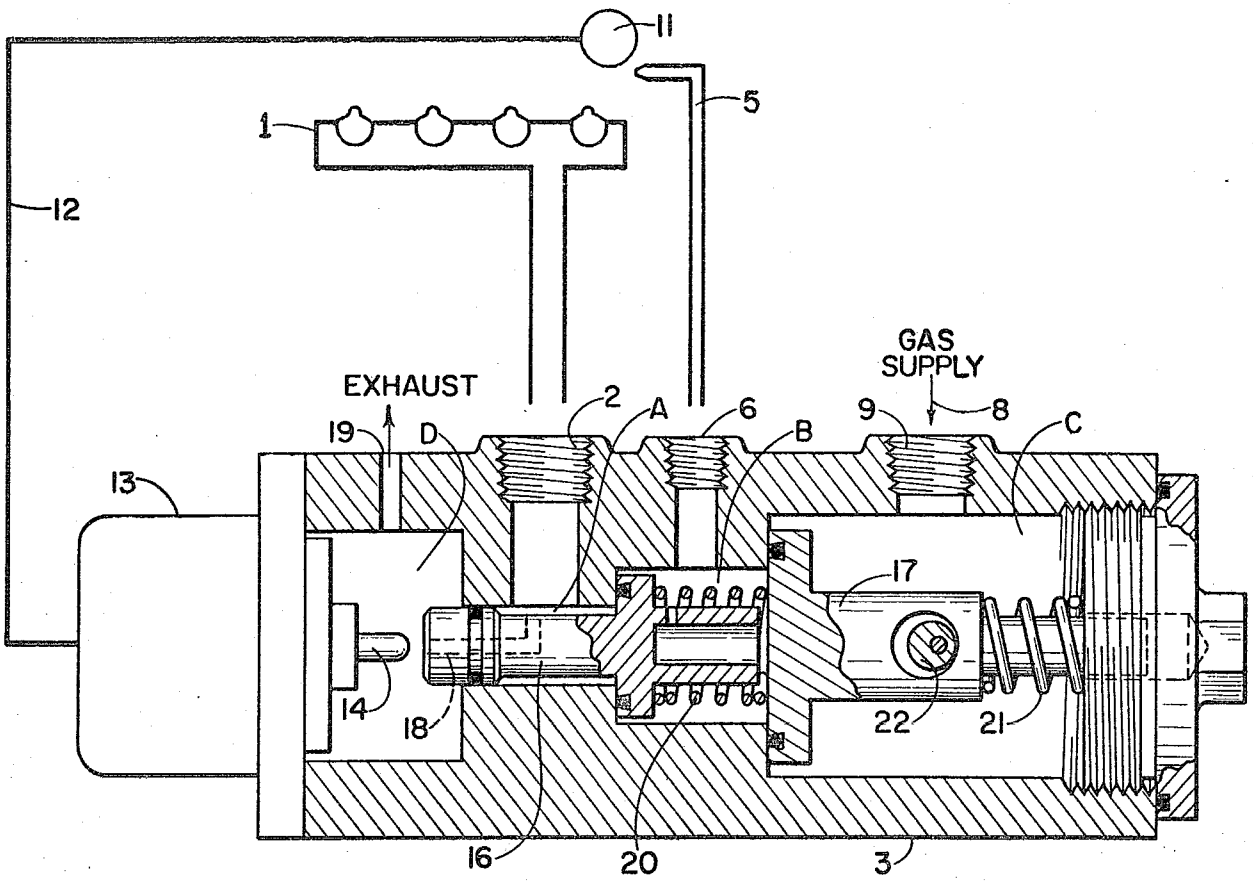
FIG. 1 is a sectioned elevation of a main burner-pilot burner system connected to a fuel supply through a valve system in its "shut-down" position embodying the present invention.

The drawing disclosure is organized to show the valve system embodying the invention between a fuel supply and the pilot and main burners. A separate valve for each burner will be identified as isolating the common fuel supply to each burner until the valves are actuated manually and automatically. The automatic operation of the valves refers to a closed fluid pressure system mounted on the pilot burner so that the heat of the flame at the pilot burner will increase the pressure of the closed system and move a piston a predetermined distance. The predetermined distance moved by the mechanical element of the closed system will actuate both fuel valves against the force of their springs, which system embodies the invention.

The fuel valve of the pilot burner, which is normally closed by spring force, is manually opened by a ratchet mechanism which will be released by the movable element of the temperature responsive fluid-presure system. Simultaneously, the fuel valve of the main burner, which is normally closed by spring force, will be opened by the movable element. Thus, the main burner valve is opened at the same time the ratchet mechanism is released. If a malfunction of this mechanical train prevents release of the ratchet mechanism, and the mechanical element is reversed, the main burner valve is spring closed to isolate the fuel supply from the main burner.

The "Shut-down" Position

FIG. 1 discloses all the embodying structure of the invention prior to lighting the pilot burner. Main burner 1 is connected to port 2 of valve system housing 3. Port 2 connects main burner chamber A within the housing to burner 1. It is this chamber A which will be valved ro receive fuel from the main supply and, thereby, pass it to burner 1.

Pilot burner 5 is connected to port 6 of housing 3. Thus, the pilot burner is connected to chamber B is housing 3. It is this chamber B which will be valved to connect the pilot burner to the common fuel supply 8. Fuel supply 8 is connected to port 9 in housing 3. This port 9 connects the common fuel supply to chamber C from which the fuel is valved to chamber B and, thence, to main burner chamber A.

A closed fluid pressure system is represented by a bulb 11 mounted on the pilot burner 5 and connected by a capillary tube 12 to a chamber 13. Chamber 13 has a spring-loaded piston element 14 protruding from chamber 13. The spring acts on the piston element 14 to withdraw it into the chamber while the increasing pressure within the system opposes the force of the spring to extend the piston element. Chamber 13 is mounted so that element 14 will extend into chamber D and engage the mechanical train formed by the valves for chambers A, B and C. This arrangement provides the mechanical linkage between the movable element of the closed fluid pressure system and both the valve between the main burner and the fuel supply and the manually operated ratchet mechanism.

Main burner valve element 16 is mounted within housing 3 to extend from chamber D through chamber A and into chamber B. This valve element 16 is shown as it seals between chambers A and B effectively isolating main burner 1 from fuel supply 8. Also, pilot burner valve element 17 is mounted in chamber C to seal between chamber C and pilot burner chamber B. As shown in FIG. 1, valve element 17 is seated to effectively isolate both pilot burner 5 and main burner 1 from the fuel supply 8.

As disclosed in FIG. 1, neither burner 1, nor burner 5, is lit. In this "shut-down" position, both burners are effectively isolated from the fuel supply. Further, the closed fluid pressure system is not actuated, its movable element 14 is retracted by its spring to the left, as disclosed in FIG. 1. A passage 18 in valve element 16 is open to connect chamber A to chamber D and exhaust port 19, when element 14 is unseated from the end of passage 18 in chamber D. When piston element 14 engages the end of the mechanical train, beginning with valve element 16, it simultaneously seats as a valve element on the chamber D opening of passage 18. Valves 16 and 17 and movable element 14 within housing 3 are prepared for actuation which will initiate the operation of the main burner 1. In place, valve element 16 is moved to the left, against its seal between chambers B and A, by a spring 20. Spring 20 is mounted within chamber B wherein it is compressed to exert force on valve element 16 to urge it toward the left, as viewed in the drawing. Valve element 17 is spring-urged to the left to seal between chambers C and B. Spring 21 is mounted in chamber C to provide this force. Cam 22 is mounted on valve element 17 so that it may be manually rotated against a torsion spring force to move valve element 17 to the right against the force of spring 21. This is the initial action taken to start the system.

The "Start" Position

Figure 2:
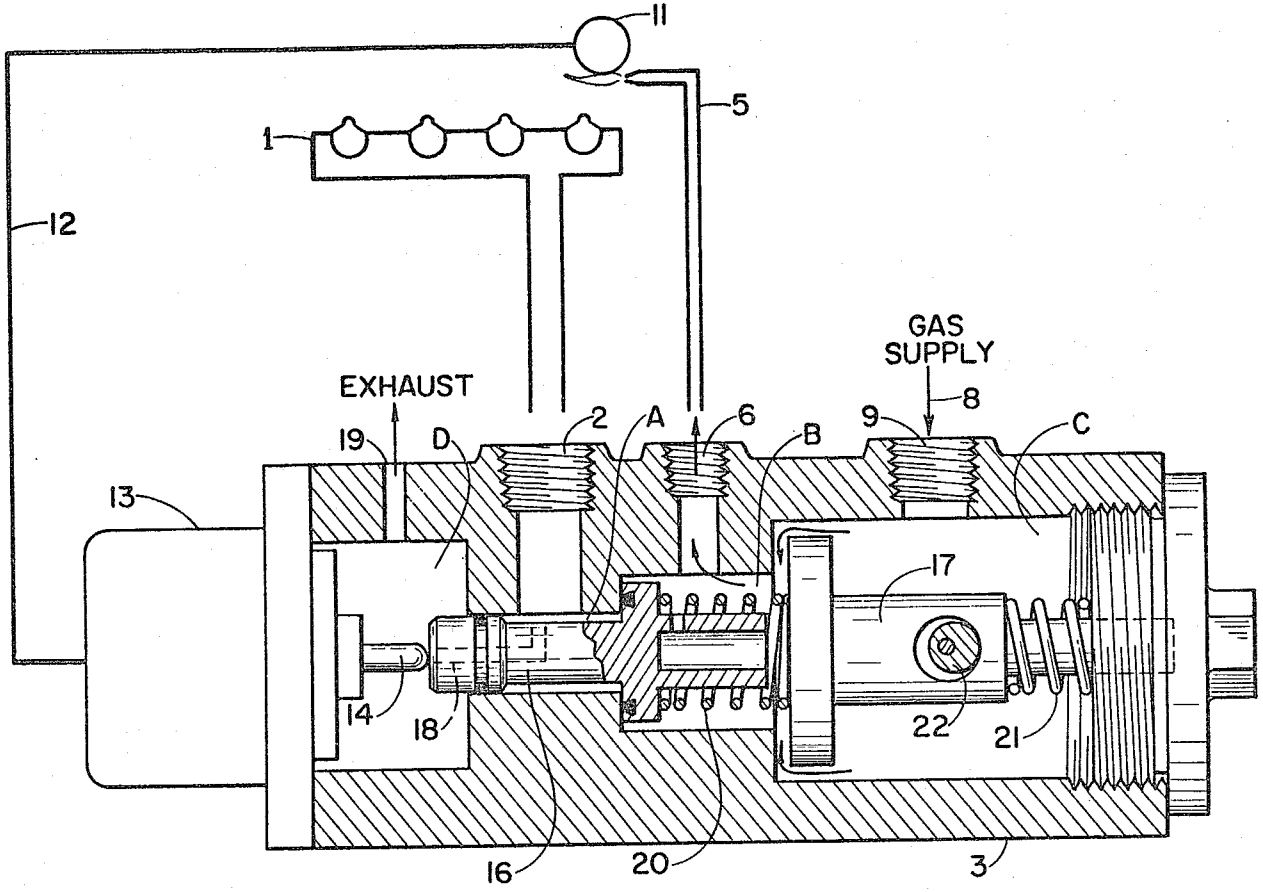
FIG. 2 shows the valve system of FIG. 1 in its "start" position, with the pilot burner connected to the fuel supply by manual operation.

FIG. 2 compares with FIG. 1 except that valve element 17 is shown as moved to the right against the force of spring 21 by the manual rotation of cam 22. The fuel supplied chamber C then flows into pilot burner chamber B and out port 6 to the pilot burner 5 for ignition by a system not disclosed.

The cam 22 may be referred to as a ratchet in that it is shaped to move valve element 17 to the right and lock valve 17 in its position to the right against the force of spring 22. Subsequently, valve element 17 can be moved further to the right and cam 22 will be released from its spring so that when the force is removed from valve element 17, it will automatically move under the force of spring 21 and reseal between chamber C and pilot burner chamber B. However, in the position of valve element 17 disclosed in FIG. 2, it is apparent that pilot burner 5 can be ignited and bulb 11, capillary 12, the chamber 13 are sensitive to the heat of pilot burner 5 and generate the fluid pressure force which will move piston element 14 to the right to oppose and overcome its spring force to seat passage 18 at the left end of valve element 16.

The "Run" Setting

Figure 3:
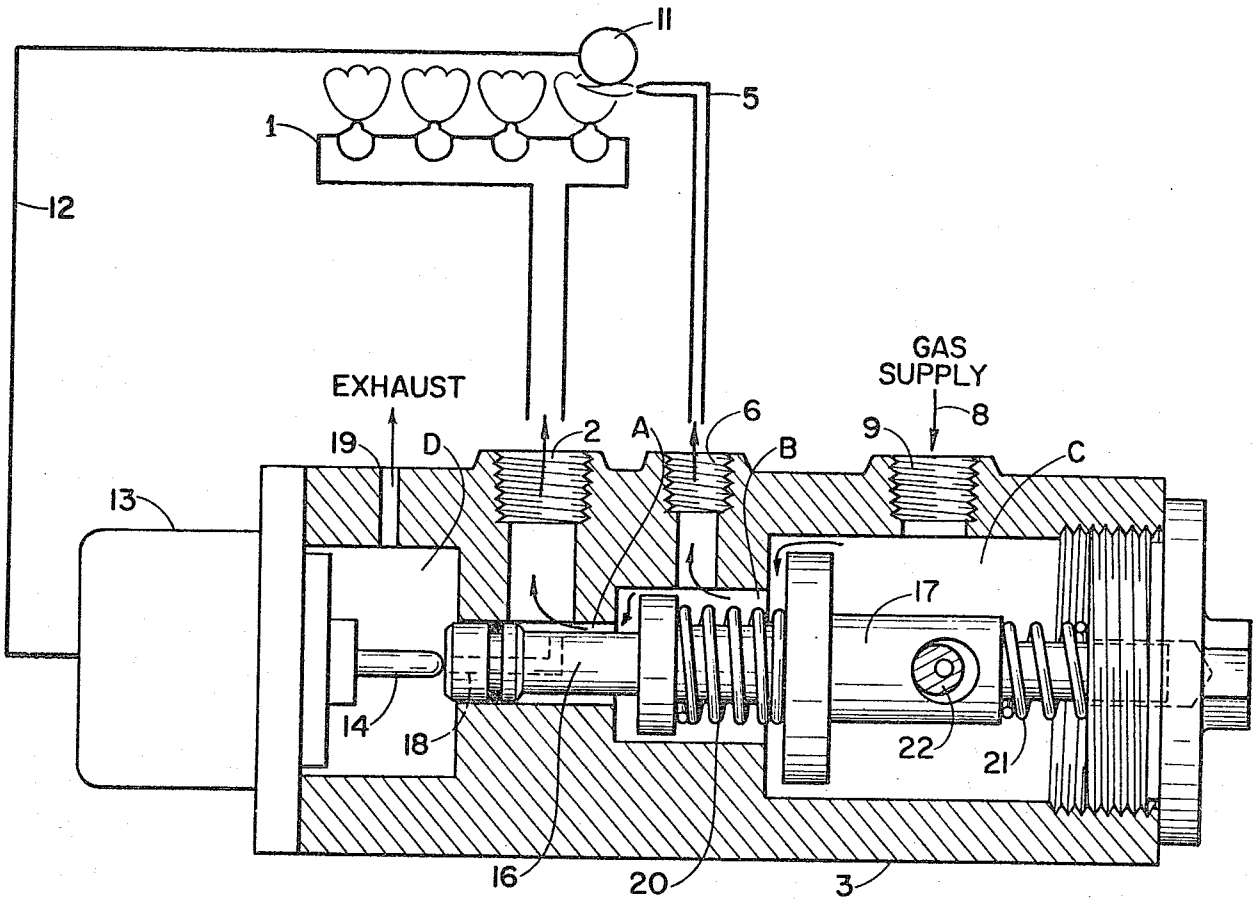
FIG. 3 is the valve system of FIGS. 1 and 2 in its "run" position.

FIG. 3 discloses the structure of FIG. 2 but with both pilot burner valve element 17 and main burner valve element 16 forming a mechanical train moved to the right. This movement has been brought about by the extension of piston element 14 to the right, engaging the left end of valve element 16 to move valve element 16 to the right against the force of spring 20. Valve element 16, moved to the right, has broken its seal between chambers A and B, thereby communicating fuel supply 8 to main burner 1.

The movement of valve element 16 has been far enough to the right to bear against the face of valve element 17 and move it to the right enough to release ratchet, or cam 22 from its torsion spring. Thus, upon the extinguishment of combustion at pilot burner 5, valve element 17 will move to the left, as permitted by the retreat of piston element 14, and both valve elements 16 and 17 will reseal chambers A, B and C from each other which will effectively isolate the fuel of source 8 from both burners 1 and 5. The relative position of all structure will return to that disclosed in FIG. 1 and the cycle of operation can be initiated again, providing the closed fluid pressure system of 11, 12, 13 and 14 are operative.

In the event it is preferred to have the gas output of port 2 applied to the diaphragm of a fuel valve directly connected to burner 1, it will be necessary to exhaust the system connected to the diaphragm when the "no-run" position of FIG. 1 returns. It is to vent this main burner control system that passage 18 from chamber D and exhaust passage 19 are provided. After the operation during the "run" condition is provided, passages 18 and 19 are sealed from each other by piston element 14 acting as a valve on the chamber D seat of passage 18. When piston element 14 is withdrawn by its spring, passages 18 and 19 are effectively connected and the gas of port 2 is exhausted to preclude any opening of the main burner to a fuel supply.

Conclusion

The basic objective of the system disclosed is safety. Safety lies in the direction of providing an arrangement which will connect burner 1 to a fuel supply only when there is combustion at pilot burner 5. The present invention provides valve element 16 to break the seal between the fuel provided for burner 5 to main burner 1 only when the bulb 11 is sufficiently heated to move piston element 14 against its return spring and valve spring 20.

If an accident causes extinguishment of combustion at pilot burner 5 at this point in the operation, piston element 14 will be withdrawn into its chamber 13 by its spring and valve element 16 will again seal fuel from reaching burner 1. Port 2 will be connected to exhaust to insure that burner 1 remains isolated from fuel.

Should normal combustion at pilot burner 5 continue until fuel is valved to burner 1, valve element 16 will continue to move against its spring 20 until valve 17 is unlatched from the spring-loaded cam 22. Once cam 22 is unlatched, both valve elements 16 and 17 will return to their sealed position when combustion at pilot burner 5 is extinguished. There may be some adjustment made in the lengths of valve elements 16 and 17 to determine their unseating sequence with the unlatching of cam 22. However, this is a minor design consideration relative to the invention embodied in the structure as disclosed.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without referece to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

We claim:

1. A system for controlling the fuel to a burner and its pilot, including, a supply of fluid fuel, a main burner adapted to be connected to the supply of fuel, a pilot burner adapted to be connected to the supply of fuel, a housing containing a first chamber adapted to be connected to the main burner, a second chamber in the housing connected to the pilot burner and the first chamber through a valve, a third chamber in the housing connected to the fuel supply and the second chamber through a valve, a first valve element normally closed by being spring-urged to seal between the first and second chambers, a second valve element normally closed by being spring-urged to seal between the second and third chambers and arranged to be unseated by engagement with the first valve element, a closed fluid pressure system arranged to respond to combustion at the pilot burner and to generate movement of an included piston element within the housing, means for temporarily and manually unseating the second valve element to permit flow of fuel from the supply through the third chamber and into the second chamber and to the pilot burner where its combustion generates the heat which develops the force in the closed system and the mechanical movement of the piston within the housing, and an arrangement within the housing for the piston of the closed fluid pressure system to engage the movable valve elements and overcome their spring forces to maintain the elements unseated and release the manual control which had temporarily unseated the second valve element.

2. A system for controlling the fuel to a burner and its pilot, including, a main burner, a pilot burner, a supply of fluid fuel, a first chamber connected to the main burner, a second chamber connected to the pilot burner, a third chamber connected to the fuel supply, a first valve between the first and second chambers, a second valve between the second and third chambers, a manual means operable to temporarily actuate the second valve to provide fuel to the second chamber and pilot burner, a movable piston element responsive to the combustion at the pilot burner and arranged to engage the first valve to connect the second chamber to the third chamber and release the second valve from the temporary manual control, a first spring element arranged to urge the first valve normally closed in opposition to the movement of the piston element, and a second spring element arranged to urge the second valve normally closed against the force of the piston element.

3. The system of claim 2, in which, the chambers and valves are within a single housing into which the movable piston element extends to actuate the first valve and the second valve in series.

4. The system of claim 3, in which, the movable piston element extends into a first end of the housing to engage the movable element of the first valve which in turn engages the movable element of the second valve against the forces of the first and second springs.

5. A valve system, including, an elongated housing, a movable piston element extending into a first end of the housing, a first valve mounted in the housing in an arrangement whereby the movable element of the valve is unseated by the piston element moving in a first direction, a second valve mounted in the housing in an arrangement whereby its movable element is engaged by the movable element of the first valve after the second valve element has been manually unseated, a manually operated cam element through which the movable element of the second valve is unseated and held unseated until the movable element of the second valve is engaged and moved by the movable element of the first valve, a supply of fluid fuel to the second valve, a pilot burner connected to the supply of fuel through the second valve when the movable element of the second valve is unseated, a main burner connected to the supply of fuel through the first and second valves in series when the movable elements of both valves are unseated, and a closed fluid pressure system mounted on the pilot burner and including the movable piston element, whereby combustion at the pilot burner will develop a fluid pressure force which will move the piston element into engagement with the first valve to unseat the first valve and move the movable element of the first valve into engagement with the movable element of the second valve to disengage the second valve element from manual control so that combustion at the pilot burner will maintain both valves open for the period of combustion at the pilot burner and will result in both valves being closed when combustion terminates at the pilot burner.

* * * * *